US005317232A

United States Patent [19]

Barakitis et al.

[11] Patent Number: 5,317,232

[45] Date of Patent: May 31, 1994

[54] AC/DC-OPERABLE GLOW DISCHARGE STARTER HAVING TWO BIMETALS

[76] Inventors: Nikolaos Barakitis, 10B May St., Salem, Mass. 01970; Marvin S. Corrales, San Jose, Desamparados; Jovge C. Rodriquez, Roma Jardines, Heredia, both of Costa Rica

[21] Appl. No.: 916,044

[22] Filed: Jul. 17, 1992

[51] Int. Cl.[5] ..... H01J 17/30; H01J 61/64

[52] U.S. Cl. ..... 313/619; 313/620; 313/622; 313/147; 315/73; 337/22

[58] Field of Search ..... 313/619, 620, 621, 622, 313/146, 147; 315/73; 337/22, 23, 24, 25, 26, 27

[56] References Cited

U.S. PATENT DOCUMENTS

| | | | |
|---|---|---|---|
| 2,376,669 | 5/1945 | De Toro . | |
| 2,673,266 | 3/1954 | Björakman | 337/27 |
| 2,740,861 | 4/1956 | Lake . | |
| 4,845,406 | 7/1989 | Barakitis et al. | 313/558 |
| 4,882,835 | 11/1989 | Barakitis et al. | 29/622 |
| 4,970,425 | 11/1990 | Barakita | 313/619 |
| 5,097,177 | 3/1992 | Chiang | 313/619 |

*Primary Examiner*—Sandra L. O'Shea
*Assistant Examiner*—Nimesh Patel
*Attorney, Agent, or Firm*—Bacon & Thomas

[57] ABSTRACT

A glow discharge starter having an hermetically sealed envelope containing an ionizable medium, a bimetallic electrode including a first bimetallic element having a curved portion and a free end, and a counter electrode. A first discharge gap having a predetermined spacing is formed between the free end of the first bimetallic element and the counter electrode. The starter includes a second bimetallic element having an end secured to the counter electrode. A portion of the second bimetallic element is positioned adjacent the curved portion of the first bimetallic element such that a second discharge gap having a predetermined spacing is formed therebetween. In the event that the starter encounters a dc current of the wrong polarity, a portion of the second bimetallic element contacts the first bimetallic element so as to extinguish the arc discharge and prevent electrode damage.

5 Claims, 1 Drawing Sheet

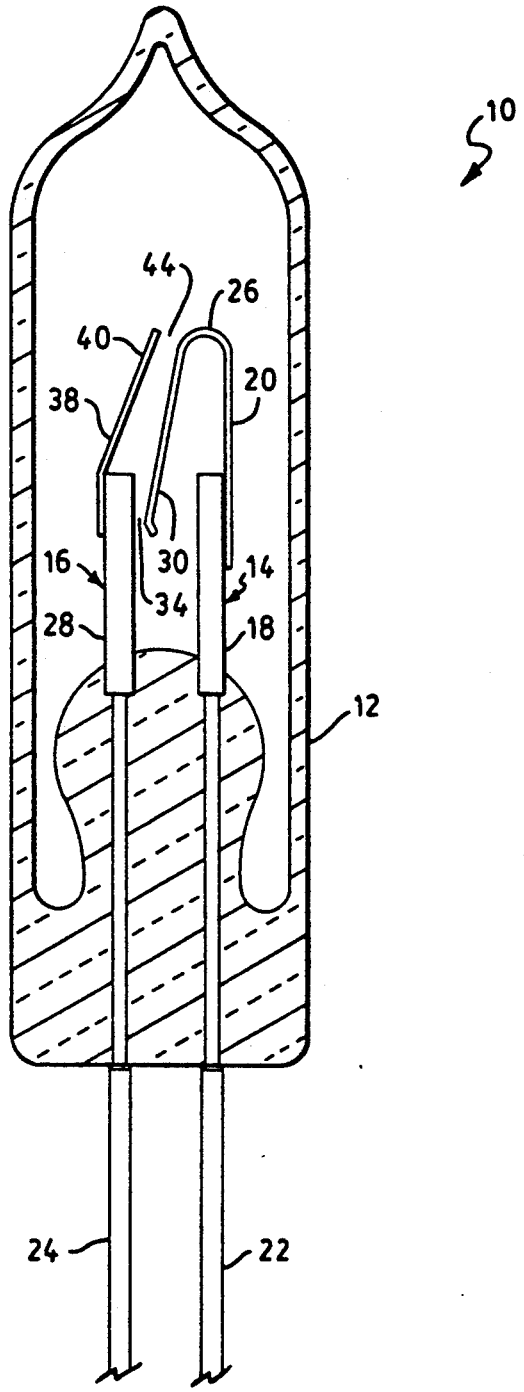
10
44
26
40
20
38
16
30
14
34
28
18
12
24
22

AC/DC-OPERABLE GLOW DISCHARGE STARTER HAVING TWO BIMETALS

FIELD OF THE INVENTION

This invention relates in general to a glow discharge starter for arc discharge lamps such as fluorescent lamps and pertains, more particularly, to a glow discharge starter intended for use on either ac or dc circuits.

BACKGROUND OF THE INVENTION

In preheat fluorescent lamp circuits, a glow discharge starter is connected in shunt with the discharge path through the lamp and in series with the lamp electrodes. The glow discharge starter contains a pair of electrodes, at least one of which comprises a heat-deformable bimetallic element, within a glass envelope containing an ionizable medium. When heated as a result of a glow discharge within the starter, the bimetallic element bends towards the other electrode.

At starting, the open circuit voltage of the ballast exceeds the breakdown voltage of the starter and produces a glow discharge therein which heats the bimetallic element and causes it to engage the other electrode in the starter. The closure of the switch effectively short circuits the lamp electrodes in series across the ballast, thereupon the increased current flow through the electrodes raises them rapidly to an electron-emitting temperature. Simultaneously, the glow discharge in the starter is extinguished and the bimetallic element begins to cool and withdraw from the contacted electrode. When contact is broken, a voltage pulse induced by the induction of the ballast, appears across the opposed electrodes of the lamp thereby initiating an arc discharge within the lamp. If lamp ignition does not occur after the first voltage pulse, the glow discharge sequence is repeated until lamp ignition occurs. After the main voltage through the lamp has started, the voltage drop thereacross is less than the breakdown voltage of the starter so that the starter does not develop a glow discharge and its electrodes remain disengaged.

Glow discharge starters are generally designed for operation on either ac or dc circuits. Typically, a starter intended for use on only dc circuits requires the electrode which is connected to the positive polarity to have a surface area at least 10 times that of the other electrode.

A typical glow discharge starter intended for use on only ac current applications may encounter problems if operated on dc. More specifically, in a typical ac glow discharge starter containing a single bimetallic electrode, if the post of the counter electrode is connected to the positive polarity while the bimetallic electrode is connected to the negative polarity, a sustained arc may be established between the electrodes. This sustained arc, if not immediately extinguished, may damage the starter electrodes and cause failure of the glow discharge starter.

In the above example, this problem can be prevented if it were possible to insure that the positive polarity is always connected to the bimetallic electrode and the negative polarity is connected to the counter electrode. Since many glow discharge starters are often enclosed within a lamp base or a container and generally do not contain polarity markings, it is difficult to insure the proper polarity to the electrodes.

Lamp ballasts intended for use with emergency lighting systems often operate lamps on ac current during normal operation. However, immediately following a power failure the lamps may briefly encounter a dc voltage before the ballast of emergency lighting system switches to a high frequency ac voltage. If the electrodes of an ac starter happen to be connected to the wrong polarity during this brief encounter with the dc voltage, failure of the starter as described above may occur.

To overcome the difficulties mentioned above, the present invention proposes the incorporation of a second bimetallic element to act as a safety mechanism. In the event that the starter encounters a dc voltage of the wrong polarity, a portion of the second bimetallic element contacts the first bimetallic element so as to extinguish the arc discharge and prevent electrode damage.

The use of a second bimetallic elements in a glow discharge starter is well known. For example, U.S. Pat. No. 2,376,669, which issued to DeToro on May 22, 1945, described a glow discharge starter containing a pair of bimetallic strips 6 and 9.

SUMMARY OF THE INVENTION

It is, therefore, an object of the present invention to obviate the disadvantages of the prior art.

It is still another object of the invention to provide an improved glow discharge starter suitable for use on either ac or dc circuits. These objects are accomplished in one aspect of the invention by the provision of a glow discharge starter comprising an hermetically sealed envelope containing an ionizable medium, a bimetallic electrode and a counter electrode located within the envelope. The bimetallic electrode includes a first bimetallic element having a curved portion and a free end. A first discharge gap having a predetermined spacing is formed between the free end of the first bimetallic element and the counter electrode. A second bimetallic element having an end secured to the counter electrode and having a portion thereof positioned adjacent the curved portion of the first bimetallic element such that a second discharge gap having a predetermined spacing is formed therebetween. The predetermined spacing of the second discharge gap is greater than the predetermined spacing of the first discharge gap at 25 degrees Celsius.

In accordance with further teachings of the present invention, the predetermined spacing of the first discharge gap is within the range of from about 0.020 inch to about 0.030 inch. Preferably, the predetermined spacing of the second discharge gap is within the range of from about 0.032 inch to about 0.038 inch.

In accordance with further aspects of the present invention, the ionizable medium preferably includes a tri-component gas consisting of 10% helium, 30% neon and 60% argon at a pressure of about 18 torr.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWING

The invention will become more readily apparent from the following exemplary description in connection with the accompanying drawing, wherein the sole FIGURE represents a sectional, front elevational view, of a glow discharge starter according to the present invention.

BEST MODE FOR CARRYING OUT THE INVENTION

For a better understanding of the present invention, together with other and further objects, advantages and capabilities thereof, reference is made to the following disclosure and appended claims in connection with the above-described drawing.

Referring now to the sole FIGURE with greater particularity, there is shown a glow discharge starter 10 comprising an hermetically sealed envelope 12 containing an ionizable medium. The ionizable medium may comprise an inert gas or combinations thereof at a low pressure such as 18.0 torr (cold pressure). A bimetallic electrode 14 and a counter electrode 16 are located within envelope 12. The lower portions of electrodes 14 and 16 are electrically connected to or, as illustrated in the sole drawing, formed from lead-in conductors 22 and 24, respectively. Bimetallic electrode 14 includes a post 18 and a first bimetallic element 20. First bimetallic element 20, which may include a curved portion 26 and a free end 30, consists of two strips of metal having different linear coefficients of expansion welded together. The side of higher coefficient of expansion is on the inside curve of the U so that bimetallic element 20 opens out and engages counter electrode 16. Counter electrode 16 includes a post 28.

A first discharge gap 34 having a predetermined spacing is formed between free end 30 of bimetallic element 20 and post 28 of counter electrode 16. First discharge gap 34 can easily be adjusted by bending bimetallic element 20. The spacing of discharge gap 34 changes as the result of flexure of bimetallic element 20 caused by the heating action of the glow discharge or changes in the ambient temperature. First discharge gap 34 is responsible for the electrical breakdown and heating of the bimetallic element 20 when a voltage potential is applied across lead-in conductors 22 and 24. Typically, the spacing of first discharge gap 34 is within the range of from about 0.020 inch to about 0.030 inch (or 0.025±0.005 inch).

In a some glow discharge starters containing a counter electrode and a single bimetallic electrode, if the post of the counter electrode is connected to the positive polarity while the bimetallic electrode is connected to the negative polarity, a sustained arc may be established between the electrodes. This sustained arc may continue causing failure of the glow discharge starter.

In accordance with the teachings of the present invention, glow discharge starter 10 contains a second bimetallic element 38 disposed within envelope 12 and having an end secured to post 28 of counter electrode 16. The free end 40 of second bimetallic element 38 is positioned adjacent curved portion 26 of first bimetallic element 20 so that a second gap 44 having a predetermined spacing is formed. The exact location of second discharge gap 44 is selected so that the gap spacing remains substantially constant during the flexure of bimetallic element 20.

Similar to first bimetallic element 20, second bimetallic element 38 is formed from two strips of metal having different linear coefficients of expansion welded together. The side of higher coefficient of expansion of second bimetallic element 38 is disposed on the outside surface thereof so that bimetallic element 38 moves inwardly towards a portion of first bimetallic element 20 adjacent U-shaped portion 26.

As illustrated in the sole FIGURE, the spacing of gap 44 formed between the two bimetallic elements 20 and 38 is greater than the spacing of discharge gap 34 formed between free end 30 of first bimetallic element 20 and post 28 of counter electrode 16 when measured at room temperature (i.e., 25 degrees Celsius). Typically, the spacing of second discharge gap 44 is within the range of from about 0.032 inch to about 0.038 inch. Second discharge gap 44 can easily be adjusted by bending second bimetallic element 38 at the knee.

The two bimetallic elements are constructed from similar materials but, in addition to their preferred shapes as depicted in the sole Figure, differ from each other in that they have different thicknesses. Bimetallic element 40 is thinner than element 20 and therefore is more sensitive and responds more rapidly to temperature. Typically, bimetallic element 40 contacts bimetallic element 20 at a temperature within the range of from about 300–350 degrees Celsius in about 1.4 seconds. Because of its greater mass, bimetallic element 20 generally requires 4.8 seconds at a temperature within the range of from about 180–200 degrees Celsius before free end 30 contacts post 28 of counter electrode 16.

The operation of glow discharge starter 10 on ac and dc circuits will now be described in detail. In the first instance when electrodes 14 and 16 are connected to an ac voltage or when bimetallic electrode 14 is connected to a positive polarity and counter electrode 16 is connected to a negative polarity, a glow discharge is produced between electrodes 14 and 16. The heat generated by the glow discharge heats first bimetallic element 20 and causes free end 30 to engage post 28 of counter electrode 16. The closure of bimetallic element 20 effectively short circuits the lamp electrodes in series across the ballast, thereupon the increased current flow through the electrodes raises them rapidly to an electron-emitting temperature. Simultaneously, the glow discharge in the starter is extinguished and bimetallic element 20 begins to cool and withdraw from contacted electrode 16.

In the second instance when bimetallic electrode 14 is connected to a negative polarity and counter electrode 16 is connected to a positive polarity, a sustained arc discharge may be produced between electrodes 14 and 16. The intense heat generated by this arc discharge causes second bimetallic element 38 with its lighter mass to respond more rapidly than first bimetallic element 20. Accordingly, second bimetallic element 38 deflects toward first bimetallic element 20 causing free end 40 to contact first bimetallic element 20 at a location adjacent U-shaped portion 26. As a result, the arc discharge is extinguished before any damage occurs to either of the starter electrodes. The closure of bimetallic element 38 effectively short circuits the lamp electrodes resulting in increased current flow through the lamp electrodes as described above. Simultaneously, the arc discharge in the starter is extinguished and bimetallic element 38 begins to cool and withdraw from bimetallic element 20.

When contact is broken in either instance, a voltage pulse induced by the induction of the ballast, appears across the opposed electrodes of the lamp thereby initiating an arc discharge within the lamp. If lamp ignition does not occur after the first voltage pulse, the glow discharge sequence is repeated until lamp ignition occurs.

In a typical but not limiting example of a glow discharge starter made in accordance with the teachings of the present invention, the envelope is formed from potash soda lead glass having an outside diameter of 0.285 inch (7.2 millimeters), a wall thickness of 0.027 inch (0.69 millimeters) and an overall length of 1.1 inch (28 millimeters). The hermetically sealed envelope contained a tri-component gas consisting of 10% helium, 30% neon and 60% argon at a pressure of 18 torr (cold). The spacing of the discharge gap formed between the free end of a U-shaped bimetallic element and an adjacent contact post is approximately 0.025 inch (0.64 millimeters). The thickness of the U-shaped bimetallic element is about 0.008 inch. A second discharge gap formed between the free end of a second bimetallic element having a thickness of about 0.005 inch (0.127 millimeter) is approximately 0.035 inch (0.89 millimeter). A coating of thorium oxide may be disposed within the starter envelope, for example, on the glass bead in order to provide electrons for starting.

There has thus been shown and described an improved glow discharge starter. The invention proposes the incorporation of a second bimetallic element to act as safety mechanism. In the event that the starter encounters a dc current of the wrong polarity, a portion of the second bimetallic element contacts the first bimetallic element so as to extinguish the arc discharge and prevent electrode damage. While there have been shown and described what are at present considered to be the preferred embodiments of the invention, it will be apparent to those skilled in the art that various changes and modifications can be made herein without departing from the scope of the invention. The embodiment shown in the drawing and described in the specification is intended to best explain the principles of the invention and its practical application to hereby enable others in the art to best utilize the invention in various embodiments and with various modifications as are suited to the particular use contemplated.

What is claimed is:

1. A glow discharge starter comprising an hermetically sealed envelope containing an ionizable medium, a bimetallic electrode and a counter electrode located within said envelope, said bimetallic electrode including a first bimetallic element having a curved portion and a free end, a first discharge gap having a predetermined spacing is formed between said free end of said first bimetallic element and said counter electrode, a second bimetallic element having an end secured to said counter electrode and having a portion thereof positioned adjacent said curved portion of said first bimetallic element such that a second discharge gap having a predetermined spacing is formed therebetween, the predetermined spacing of said second discharge gap being greater than said predetermined spacing of said first discharge gap at 25 degrees Celsius.

2. The glow discharge starter of claim 1 wherein said predetermined spacing of said first discharge gap is within the range of from about 0.020 inch to about 0.030 inch.

3. The glow discharge starter of claim 1 wherein said predetermined spacing of said second discharge gap is within the range of from about 0.032 inch to about 0.038 inch.

4. The glow discharge starter of claim 1 wherein said ionizable medium includes a tri-component gas consisting of 10% helium, 30% neon and 60% argon.

5. The glow discharge starter of claim 4 wherein said predetermined pressure is about 18.0 torr.

* * * * *